United States Patent [19]

Güttler et al.

[11] Patent Number: 4,472,932

[45] Date of Patent: Sep. 25, 1984

[54] THREAD GUARD FOR SPINNING OR TWISTING MACHINE

[75] Inventors: Hermann Güttler, Uhingen; Berd Lagemann, Göppingen, both of Fed. Rep. of Germany

[73] Assignee: Zinser Textilmaschinen GmbH, Ebersbach/Fils, Fed. Rep. of Germany

[21] Appl. No.: 443,561

[22] Filed: Nov. 22, 1982

[30] Foreign Application Priority Data

Nov. 23, 1981 [DE] Fed. Rep. of Germany ..... 31463800

[51] Int. Cl.[3] ..... D01H 13/16

[52] U.S. Cl. ..... 57/80; 57/81; 57/86; 57/87

[58] Field of Search ..... 57/78, 80, 81, 83–87

[56] References Cited

U.S. PATENT DOCUMENTS

| | | | |
|---|---|---|---|
| 2,494,490 | 1/1950 | Rinehart et al. | 57/86 |
| 3,163,341 | 12/1964 | Fisher et al. | 57/80 X |
| 3,759,026 | 9/1973 | Hope | 57/80 |
| 4,110,963 | 9/1978 | Plate et al. | 57/86 |
| 4,292,798 | 10/1981 | Gore et al. | 57/86 |

FOREIGN PATENT DOCUMENTS

| | | |
|---|---|---|
| 7912423 | 8/1979 | Fed. Rep. of Germany . |
| 877153 | 9/1961 | United Kingdom . |
| 922773 | 4/1963 | United Kingdom . |
| 1543885 | 4/1979 | United Kingdom . |
| 2042600 | 9/1980 | United Kingdom . |
| 2080346 | 2/1982 | United Kingdom . |
| 2085929 | 5/1982 | United Kingdom . |

*Primary Examiner*—John Petrakes

*Attorney, Agent, or Firm*—Karl F. Ross; Herbert Dubno

[57] ABSTRACT

A device attached to a spinning or twisting machine, designed to monitor the integrity of two threads merging under tension into a yarn, has a carrier in the form of a disk or a stem rotatable about an axis and provided with a thread guide such as an eyelet, or a pair of pins parallel to that axis, bracketing the yarn downstream of the merger point. A rupture of either thread, detected by a separate sensor or by one of the bracketing pins, generates or releases a force which rotates the carrier around its axis by about half a turn to impede the advance of the remaining intact thread whereby the latter also breaks and the machine is stopped automatically, or manually in response to an alarm signal.

14 Claims, 8 Drawing Figures

THREAD GUARD FOR SPINNING OR TWISTING MACHINE

FIELD OF THE INVENTION

Our present invention relates to a device, referred to hereinafter as a thread guard, which is attached to a spinning or twisting machine for the purpose of monitoring the integrity of two threads merging into a yarn under tension exerted thereon by a bobbin-carrying spindle, a take-up reel or other means disposed downstream of the thread junction. The threads merged at that junction need not be individual filaments but could also be, for example, slivers advanced by feed rollers of a draw frame.

BACKGROUND OF THE INVENTION

If either of the contributing threads should break upstream of the merger point, the remaining thread would continue for some time to be drawn by the tensioning means to produce a defective length of yarn even if the machine were promptly deactivated—manually or automatically—in response to a signal from a sensor detecting the break. It is therefore desirable that a thread guard have means responsive to a rupture of either thread for quickly breaking the other thread in order to prevent the wasting of a significant portion of that thread and to avoid the production of a defective yarn section. Thus, German utility model No. GM 79 12 423 discloses a thread guard of this nature comprising a swingable member disposed just downstream of a thread junction for guiding engagement with the yarn in a normal position of that member from which it is limitedly displaceable to one side or the other by minor differences in the tension of the contributing threads. When this difference exceeds a certain threshold, as will be the case in the event of a thread rupture, the guide member is deflected into an off-normal position in which it impedes the advance of the intact thread so as to cause its rupture. In a specific instance, the guide member is balanced on a horizontal pin and its normal position is metastable so that gravity makes it rotate through 180° when the limits of lateral deflection are surpassed whereby two pins bracketing the yarn invert their relative position to entangle the remaining thread. Also mentioned is the possibility that gravity be replaced by some other stored force, such as the stress of a spring or an electromagnetic field, to create something like a toggle effect when the guided yarn strongly deviates from its regular path. In any event, the yarn is guided with considerable lateral play by the swingable member in its metastable normal position.

OBJECTS OF THE INVENTION

An object of our present invention is to provide, in textile machinery, a thread guard of the general type referred to giving more positive guidance to the engaged yarn Another object is to provide a thread guard of this kind which may be tripped by separate sensors already present in such machinery for monitoring the continuity of two converging threads.

SUMMARY OF THE INVENTION

A thread guard according to our invention comprises control means disposed in the vicinity of a junction of two merging threads for detecting a break in either of them and thereupon impeding the advance of the remaining thread, the control means including a carrier which is rotatable about an axis perpendicular to the path of the yarn and is provided with guide means bracketing the yarn in a working position of the carrier as known per se from the above-cited publication. In contradistinction to the known arrangement, however, the carrier is normally immobilized in its working position by detent means forming part of the control means, the latter further including drive means responsive to detection of a thread break for deactivating the detent means and rotating the carrier about its axis to invert the position of the guide means. The yarn-bracketing guide means may comprise, as likewise known per se from that publication, two pins flanking the yarn or an eyelet traversed by same.

The detection of a thread break may be carried out by sensing means monitoring the integrity of the threads upstream of their junction, the sensing means being part of the control means but separate from the rotatable carrier. Alternatively, the guide means may comprise a pair of pins on the carrier which are normally parallel to its axis of rotation but are outwardly deflectable transversely to that axis. A force storer forming part of the drive means engages the carrier tends to rotate it about its axis, such rotation being normally blocked by a catch on the carrier coacting with a stationary abutment. The catch is linked with the pins so as to be retracted from that abutment by a lateral excursion of the yarn due to a thread break causing an outward deflection of either pin against a force resisting such deflection, e.g. the frictional contact between the catch and the abutment. The force storer may be a torsion spring centered on the axis of rotation. A similar force storer may be used as the drive means when rotation of the carrier is to be initiated by an actuating signal from an upstream sensor, which could be of mechanical, photoelectric or other conventional type.

BRIEF DESCRIPTION OF THE DRAWING

The above and other features of our invention will now be described in detail with reference to the accompanying drawing in which.

SPECIFIC DESCRIPTION

Figure 1:
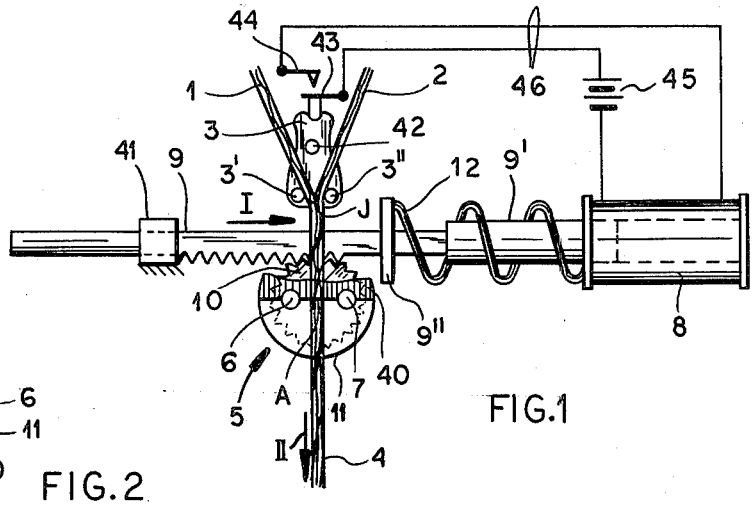
FIG. 1 is a somewhat diagrammatic front view of a thread guard embodying our invention.
Figure 2:
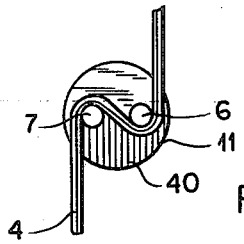
FIG. 2 is a front view of a guide member forming part of the device shown in FIG. 1.

In FIG. 1 we have shown two textile threads or slivers 1 and 2 merging into a yarn 4 at a junction J where the threads pass between two prongs 3', 3'' of a sensor 3, forming part of a thread guard 5 according to our invention, designed to monitor the continuity of both threads. Sensor 3, which is representative of any conventional means for detecting a thread rupture, is a member swingable in a vertical plane about a pivot pin 42 to close a switch with two normally open contacts 43, 44 whenever a rupture of either thread exerts upon that member an unbalancing force deflecting it to one or the other side beyond a certain tolerance limit. Such deflection generates a malfunction signal by connecting a voltage source, shown as a battery 45, in an alarm circuit 46 across a load constituted in this embodiment by the winding of a solenoid 8. A core 9' of this solenoid forms an extension of a toothed rack 9 which is slidably guided in a fixed block 41 and is normally held in a limiting position by a compression spring 12 bearing upon an abutment 9'' on that rack. Rack 9 meshes with a gear 10 which is rigid with a disk 11, shown partly broken away in FIG. 1, which is centered on a horizontal axis A and carries two guide pins 6, 7 parallel to that axis bracketing the path of yarn 4 in a normal working position. When sensor 3 detects a break and closes the switch 43, 44, the resulting energization of solenoid 8 moves the rack 9 to the right as indicated by an arrow I; the extent of this movement is at least sufficient to rotate the gear 10 and the disk 11 through 180°, i.e. into an alternate position shown in FIG. 2 in which the relatively transposed guide pins 6 and 7 exert a considerable drag on whatever is left of yarn 4. Since the yarn is being pulled by tensioning means of a spinning or twisting machine not further illustrated, as symbolized by an arrow II in FIG. 1, the drag exerted by the inverted carrier disk 11 causes the hitherto intact thread of yarn 4 to break as known per se from the above-discussed German utility model. The signal actuating the drive means represented by solenoid 8 may also trigger a malfunction indicator to apprise an operator of the detected break.

With the disentanglement of the second thread from guide pins 6 and 7, switch 42, 43 will be reopened to de-energize the solenoid 8 and to let the detent spring 12 restore the working position of FIG. 1. A colored marking 40 on half the face of disk 11 will let the operator perceive immediately whether or not the restoration to normal has taken place. When the device 5 has been properly rethreaded, normal operation will resume.

Figure 3:
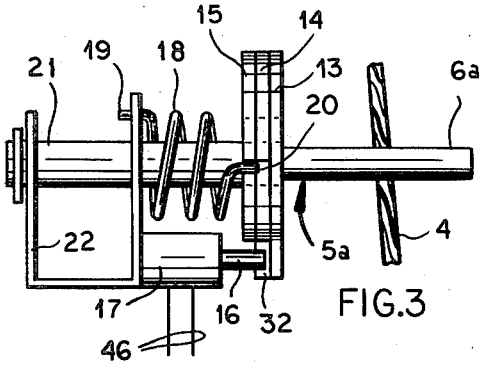
FIG. 3 is a side-elevational view of a thread guard representing another embodiment.
Figure 3A:
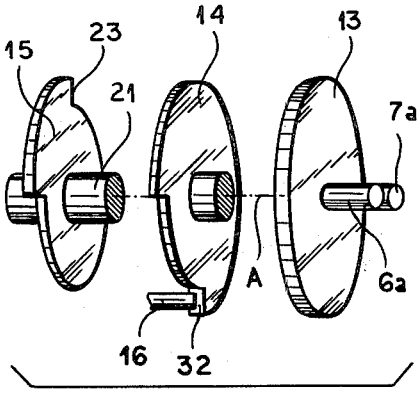
FIG. 3A is an exploded perspective view of a guide member included in the embodiment of FIG. 3.

A modified thread guard **5*a* according to our invention, shown in FIG. 3, comprises a carrier consisting of three coaxially juxtaposed disks 13, 14 and 15 (see also FIG. 3A) again centered on a horizontal axis A. The carrier 13–15 is rigid with a shaft 21 which is journaled in a stationary frame 22 engaged by one end 19 of a torsion spring 18 whose opposite end 20 bears upon aligned radial shoulders of disks 14 and 15, the spring 18 being so wound around the shaft 21 as to tend to rotate that carrier in a clockwise direction as viewed in FIG. 3A. The front disk 13 of that carrier supports two parallel guide pins 6*a* and 7*a* which, like their counterparts in the preceding embodiment, normally bracket a yarn 4 just below a point of merger of its constituent threads. A solenoid 17 mounted on frame 22 has a core 16 which normally engages a radial shoulder 32 of middle disk 14 to block the rotation of the carrier. When solenoid 17 is energized by a malfunction signal from an associated thread sensor by way of circuit 46, core 16 is partly retracted but remains extended far enough to project into the orbit of a radial shoulder 23 of rear disk 15 whereby carrier 13–15 is arrested after rotating through half a turn to reverse the relative position of guide pins 6*a* and 7*a*. In this case the operator, again alerted by the triggering of an alarm indicator through circuit 46, must manually restore the working position of FIGS. 3 and 3A by reverse-rotating the carrier 13–15 against the force of torsion spring 18. A marking visually indicating the carrier position, such as that shown at 40 in FIGS. 1 and 2, may be provided on the exposed face of front disk 13**.

Figure 4:
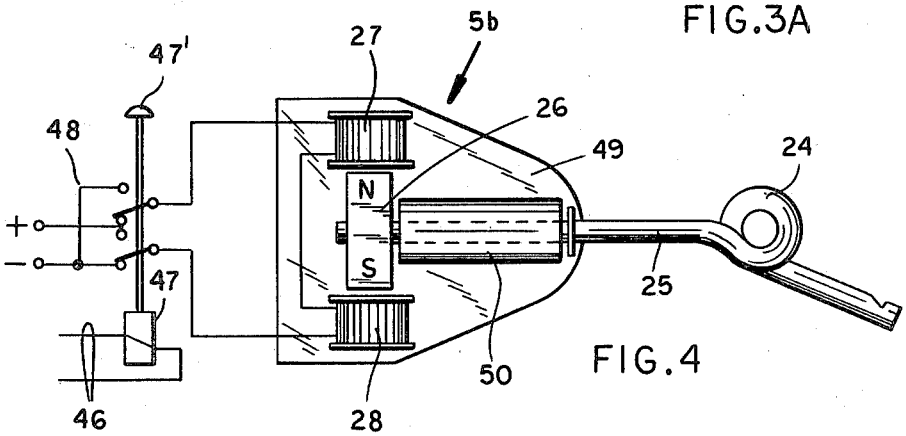
FIG. 4 is a partly diagrammatic top view of a further embodiment.
Figure 5:
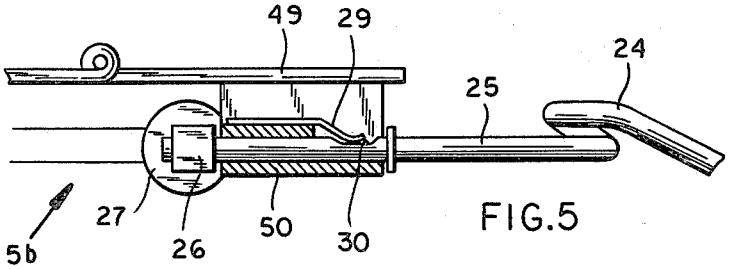
FIG. 5 is a side view, partly in section, of the embodiment of FIG. 4.

A thread guard **5*b* illustrated in FIGS. 4 and 5, representing a further embodiment of our invention, comprises a rotatable carrier in the form of a horizontal stem 25 terminating in a yarn-guiding eyelet 24. Stem 25 is journaled in an extension 50 of a stationary holder 49 and has a flat 30 normally engaged by an extremity of a leaf spring 29 fastened to that extension. The rear end of stem 25 carries a permanent bar magnet 26 which is rotatable about the horizontal stem axis between two diametrically opposite electromagnets 27 and 28 with soft-iron cores. An energizing circuit for these electromagnets includes a reversing switch 48 and a source of direct current which could be the battery 45 of alarm circuit 46 illustrated in FIG. 1. Switch 48 is controlled electrically by a relay 47 and manually by a resetting knob 47', relay 47 being connected across circuit 46 and being normally inoperative so that switch 48 is in its illustrated position after being manually reset. Under these circumstances the electromagnets 27 and 28 are traversed by current of such polarity as to tend to retain the permanent magnet 26 in the working position shown in which the stem 25 is also indexed by the detent spring 29 whereby the nonillustrated yarn passes freely through eyelet 24. When a thread break detected by an upstream sensor energizes the relay 47 via circuit 46, switch 48 is reversed so that the force now exerted by electromagnets 27 and 28 swings the bar magnet 26 through 180°, overcoming the bias of detent spring 29. The resulting inversion of eyelet 24 again exerts a drag upon the engaged yarn to rupture the thread that has remained intact After the de-energization of relay 47, as by the opening of a switch such as that shown at 43, 44 in FIG. 1, the previously alerted operator can depress the knob 47' to re-establish the normal position of thread guard 5*b*. The unsymmetrical configuration of eyelet 24 visually informs the operator whether or not the stem 25 is in its normal position. Such an eyelet, it should be noted, could also be used in lieu of the guide pins 6, 7 or 6*a*, 7*a*** of the preceding embodiments.

Figure 6:
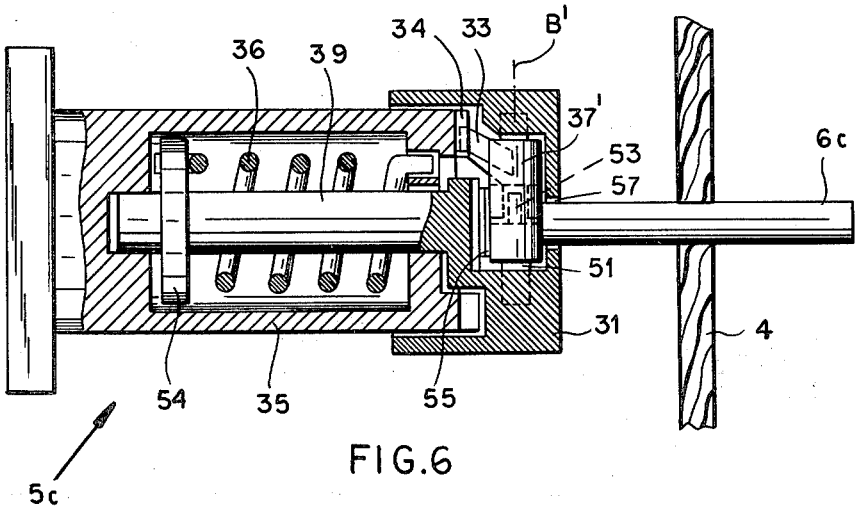
FIG. 6 is a side view, mostly in section, of a thread guard constituting still another embodiment.
Figure 7:
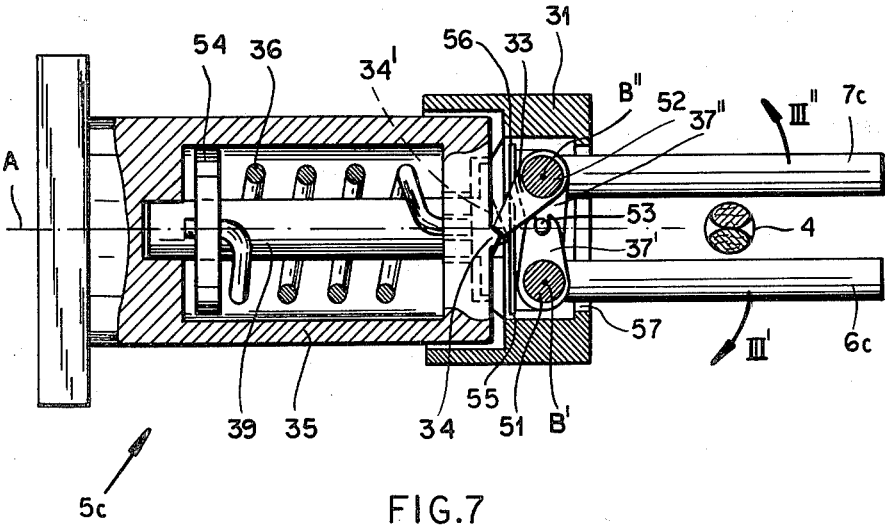
FIG. 7 is a mostly sectional top view of the embodiment of FIG. 6.

In FIGS. 6 and 7 we have illustrated a thread guard **5*c* according to our invention which does not require an upstream sensor. This embodiment comprises a stationary cylindrical housing 35, centered on a horizontal axis A, whose open end is partly embraced by a cap 31 in the form of a disk rotatable about that axis. Disk 31 carries two guide pins 6*c* and 7*c* which normally are parallel to axis A and bracket a yarn 4 just below the junction of its constituent threads, the disk being rigid with a shaft 39 which is journaled in housing 35 and is centered on axis A. An abutment 54 at the rear end of shaft 39 is engaged by one extremity of a torsion spring 36 whose other extremity is anchored to housing 35 and which tends to rotate the shaft 39 together with disk 31 in a counterclockwise direction as viewed from the right in FIGS. 6 and 7. In contrast to the guide pins of FIGS. 1–3, which are rigid with their respective carriers, pins 6*c* and 7*c* are outwardly deflectable in a plane of axis A about respective pivotal axes B' and B'' skew thereto, these pivotal axes being defined by two parallel studs 51 and 52 in cap 31 about which the two pins are swingable. Studs 51 and 52 are provided with respective radially extending lugs 37' and 37'' which are interlinked by a pin 53 on lug 37″ embraced by a bifurcate end of lug 37′ whereby an outward deflection of one guide pin is translated into an opposite deflection of the other guide pin as indicated by arrows III′ and III″ respectively associated with pins 6***c* and 7*c*. A further lug 33 rigid with pin 7*c* and stud 52 acts as a catch normally bearing upon an abutment 34, located on the edge of housing 35 surrounding its open end, to block the rotation which the torsion spring 36 is biased to impart to disk 31. The frictional contact between catch 33 and abutment 34 tends to maintain the guide pins 6*c* and 7*c* in their illustrated parallel position; their outward deflection in the direction of arrows III′ and III″ is further resisted by leaf springs 55, 56 resting against flat portions of the hubs of lugs 37′ and 37″.

When the rupture of a contributing thread deflects the yarn 4 sufficiently to swing the guide pin 6*c* or 7*c* about its pivotal axis B′ or B″ against the forces resisting such deflection, the joint swing of the interlinked guide pins disengages the catch 33 from its abutment 34 so that spring 36 rotates the disk 31 with its shaft 39 about axis A until that catch is intercepted by another, taller abutment 34′ on a diametrically opposite point of the rim of housing 35. The length of a slot 57 in disk 31, accommodating the pins 6*c* and 7*c*, limits the outward swing of these pins to insure such interception. Restoration of thread guard 5*c* to its normal position is again carried out manually by an operator who may have been alerted by an alarm indication from a suitable signal generator.

In all disclosed embodiments the carrier is virtually immobile (as are the pins 6*c* and 7*c* of FIGS. 6 and 7) and does not wobble so as to provide positive guidance to the engaged yarn until the sensing of a thread rupture causes a reversal of its position by a mechanical or electromagnetic force; gravity, and thus the orientation of the yarn path, is not a factor.

We claim:

1. A thread guard for textile machinery wherein two threads merge at a junction into a yarn, comprising tensioning means engaging said yarn downstream of said junction for continuously advancing same, control means disposed in the vicinity of said junction for detecting a break in one of said threads and thereupon impeding the advance of the remaining thread to cause rupture thereof under the force of said tensioning means, said control means including a carrier rotatable about an axis perpendicular to the path of said yarn, guide means on said carrier bracketing said yarn in a working position of said carrier, detent means for normally immobilizing said carrier in said working position and drive means responsive to detection of a thread break for deactivating said detent means and rotating said carrier about said axis to invert the position of said guide means.

2. A thread guard as defined in claim 1 wherein said control means includes sensing means upstream of said junction for monitoring the integrity of said threads and emitting an actuating signal for said drive means upon detection of a thread break.

3. A thread guard as defined in claim 2 wherein said detent means comprises stop means and a spring coupled with said carrier for urging same against said stop means, said drive means including an electromagnet counteracting said spring.

4. A thread guard as defined in claim 3, further comprising a gear centered on said axis and a rack in mesh with said gear, said carrier being a disk rigid with said gear, said electromagnet having a core secured to said rack, said spring bearing upon said core.

5. A thread guard as defined in claim 2 wherein said drive means comprises a torsion spring coupled with said carrier and biased to rotate same out of said working position, said detent means including abutment means on said carrier and a latch normally engaging said abutment means for restraining said carrier against the force of said torsion spring, said drive means further comprising an electromagnet coupled with said latch for retracting same from said abutment.

6. A thread guard as defined in claim 5 wherein said carrier comprises a plurality of axially juxtaposed disks, one of said disks being provided with said abutment, another of said disks having an edge engageable by said latch upon retraction thereof to arrest said guide means in a reversed position.

7. A thread guard as defined in claim 2 wherein said detent means comprises an indexing spring, said drive means including a bar magnet transverse to said axis rigid with said carrier and electromagnetic means energizable by said actuating signal to turn said bar magnet through substantially 180 °.

8. A thread guard as defined in claim 7, further comprising resetting means operable to re-establish said normal position by reverse energization of said electromagnetic means.

9. A thread guard as defined in claim 7 wherein said carrier is a stem, said guide means comprising an eyelet at an end of said stem, said indexing spring normally engaging a substantially flat surface portion of said stem.

10. A thread guard as defined in claim 1 wherein said guide means comprises a pair of pins normally parallel to said axis and outwardly deflectable transversely thereto, said drive means comprising a force storer engaging said carrier and tending to rotate same about said axis, said detent means comprising a stationary abutment and catch on said carrier normally coacting with a stationary abutment to block the rotation of said carrier by said force storer, said catch being linked with said pins for retraction from said abutment upon outward deflection thereof by a lateral excursion of the yarn due to a thread break.

11. A thread guard as defined in claim 10 wherein said force storer comprises a torsion spring and a surrounding housing centered on said axis, said carrier being a disk adjoining an open end of said housing, said abutment being formed on said housing at said open end thereof, said torsion spring being anchored to said disk and to said housing.

12. A thread guard as defined in claim 11 wherein said disk forms a cap partly surrounding said open end, said cap being provided with studs skew to said axis provided with interengaging formations coupling said studs to each other for joint swinging in opposite directions, said pins having ends journaled on said studs.

13. A thread guard as defined in claim 12 wherein said catch is a transverse projection on one of said studs.

14. A thread guard as defined in claim 1 wherein said carrier is a disk provided with a marking for visual indication of said normal position.

* * * * *